United States Patent [19]

Bhandia

[11] 3,959,989

[45] June 1, 1976

[54] RING HAVING ADJUSTABLY MOUNTED RAPIDLY ROTATABLE INDICIA-BEARING MEMBER

[75] Inventor: B. S. Bhandia, Daly City, Calif.

[73] Assignee: Lawrence Peska Associates, Inc., New York, N.Y. ; a part interest

[22] Filed: Feb. 10, 1975

[21] Appl. No.: 548,261

[52] U.S. Cl. ..... 63/15.65; 46/47; 63/1 R; 63/31

[51] Int. Cl.[2] ..... A44C 9/02

[58] Field of Search ..... 63/31, 15.65, 15.7, 63/15.5, 23, 1 R; 46/47

[56] References Cited

UNITED STATES PATENTS

| | | | |
|---|---|---|---|
| 1,558,418 | 10/1925 | Wendel | 63/15.65 |
| 2,185,811 | 1/1940 | Heyman | 63/1 R |
| 2,497,207 | 2/1950 | Burk | 63/15.7 |
| D56,563 | 11/1920 | Osborn | 63/23 UX |

FOREIGN PATENTS OR APPLICATIONS

| | | | |
|---|---|---|---|
| 1,043,964 | 6/1953 | France | 63/31 |
| 1,381,490 | 11/1964 | France | 63/31 |

*Primary Examiner*—F. Barry Shay
*Attorney, Agent, or Firm*—Jack D. Slobod

[57] ABSTRACT

A generally U-shaped member has an elongated member carried between the legs of the generally U-shaped member to form a finger ring. A generally planar member is carried for rotation by the elongated member and has indicia disposed on opposite sides thereof which is apparently simultaneously visible when the generally planar member is rotated about the axis of the elongated member. The elongated member may be detachably placed in one of plural sets of bores to adjust the ring size. Spring biased telescoping pins may be used on the elongated member to make it readily detachable.

2 Claims, 6 Drawing Figures

RING HAVING ADJUSTABLY MOUNTED RAPIDLY ROTATABLE INDICIA-BEARING MEMBER

BACKGROUND OF THE INVENTION

The invention relates to jewelry and particularly to rings intended for wearing on a finger. The prior art includes necklaces, broachs, earrings, cuff links, pendants having a generally planar member which is carried for rotation about an axis and which has indicia disposed on the opposite planar bases thereof. Rapid rotation of the generally planar member about the axis makes the indicia on opposite sides visible at the same time. Ordinarily the indicia on the opposite faces is selected such that a unitary expression is visible when the generally planar member is rotated. This approach has not heretofore believe to have been possible with rings for wearing on the finger.

Accordingly it is a primary object of the invention to provide a ring for wearing on a finger which will include a generally planar member having indicia disposed on opposite faces thereof and which is carried for rotation about an axis.

Still another object of the invention is to provide a ring which is adjustable to fit various finger sizes.

Yet another object of the invention is to provide apparatus which is simple and inexpensive to manufacture.

SUMMARY OF THE INVENTION

It has now been found that these and other objects of the invention may be attained in a ring which includes a generally U-shaped member having two elongated legs and an intermediate arcuate section. Each of the legs has a bore disposed therein. Ordinarily the bores are in aligned relationship and extend from the opposed faces of the elongated leg portions.

An elongated pin is provided having axial extremities engaging the bores. A generally planar member is carried on the pin for rotation about the axis of the pin. The generally planar member has indicia disposed on opposite faces thereof and all of the indicia are visible when the generally planar member is rotated about the axis of the pin.

In one form of the invention a plurality of pairs of aligned bores are provided at axially spaced points along the elongated legs of the generally U-shaped member. Ordinarily the pin will be provided with telescoping sections which are spring biased outward axially to further facilitate adjustments in size to accomodate various ring fingers.

BRIEF DESCRIPTION OF THE DRAWING

The invention will be better understood by reference to the accompanying drawing in which.

DESCRIPTION OF THE PREFERRED EMBODIMENT

Figure 1:
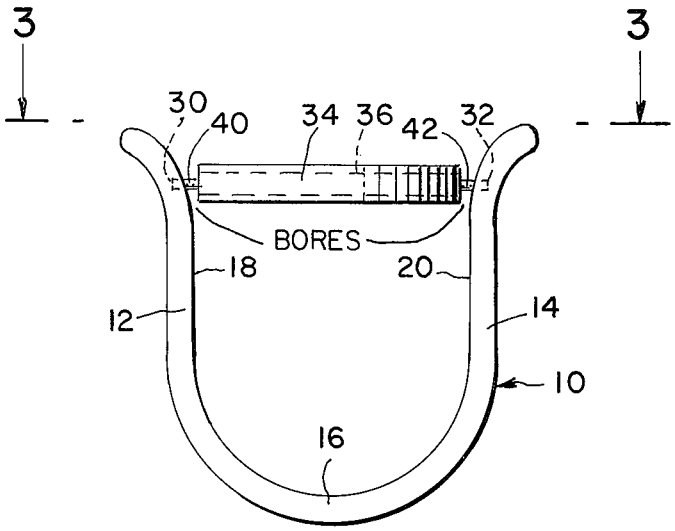
FIG. 1 is a side elevational view in accordance with one form of the invention.
Figure 2:
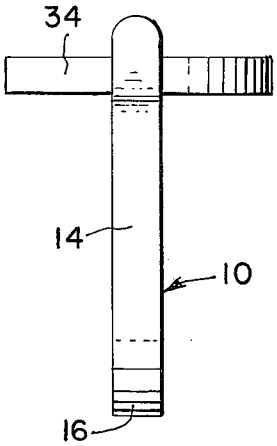
FIG. 2 is an end elevational view of the apparatus shown in FIG. 1.

Referring now to FIGS. 1 through 6 there is shown a generally U-shaped member 10 having elongated leg portions 12, 14 and intermediate the leg portions an arcuate section 16. Disposed on the opposed faces 18,20 of the elongated members are a plurality of pairs of aligned holes 30, 32.

A rotatable generally planar member 34 is carried for rotation upon a pin 36 having spring 38 biased axial sections 40, 42 for engagement with the aligned bores 30, 32. A passageway (not shown) extends through the generally planar member 34 for receipt of the pin.

Figure 3:
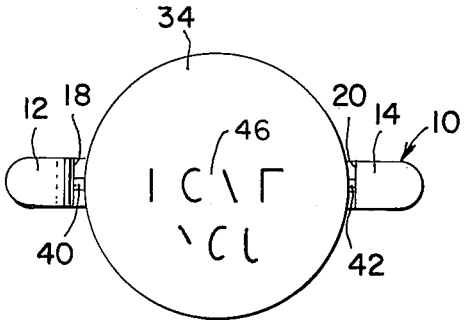
FIG. 3 is a plan view of the apparatus shown in FIG. 1.
Figure 4:
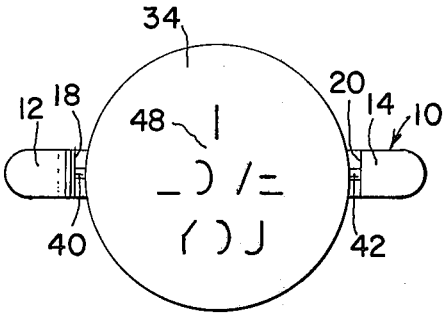
FIG. 4 is a plan view similar to that of FIG. 3 with the generally planar member rotated 180° to show the indicia disposed thereon.
Figure 5:
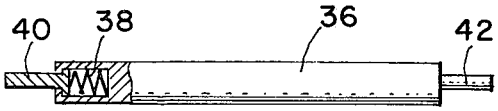
FIG. 5 is a partial broken away plan view of the pin used for carrying the generally planar member in accordance with one form of the invention.
Figure 6:
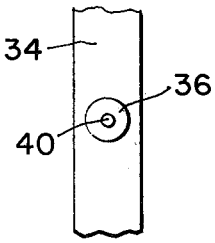
FIG. 6 is a broken away elevational view of the generally planar member and the pin which carries it.

In operation various indicia 46, 48 are placed on the two sides of the generally planar member 34 and as indicated in FIGS. 3 and 4 by way of example this may include fragments on each side of various letters. The letter combination shown in FIGS. 3 and 4 when rotated produces an image reading "I Love You". Various other phrases may be utilized without departing from the spirit of the invention.

It will be understood that in operation the generally planar member is pivoted to the position shown in FIGS. 3 and 4 and that ordinarily the wearer will prefer to position the generally planar member on the side of his hand which is most visible. Others may prefer to position the generally planar member on the palm side of the finger.

Having thus described my invention, I claim:

1. An adjustable finger ring which comprises a member having two elongated legs joined by an intermediate arcuate section and forming a U-shape, each of said legs having a plurality of bores disposed therein, at ends thereof remote from said section, each said bore of one leg being disposed in coaxial relationship with a said bore of the other leg thereby forming a plurality of pairs of coaxial bores, an elongated pin having axial extremities removably disposed in one pair of said bores, a generally planar member having oppositely facing surfaces carried on said pin and mounted for rotation about the axis thereof, said generally planar member having indicia on both said surfaces, said indicia being apparently simultaneously visible when said generally planar member is rapidly rotated about the axis of said pin, said legs, section and planar member forming the finger receiving opening of said ring, said opening being adjustable in size by means of said plurality of bores.

2. The apparatus as described in claim 1 wherein said pin has telescopic spring bias sections for selective engagement with one pair of aligned bores.

* * * * *